United States Patent [19]

Bauer et al.

[11] Patent Number: 4,580,743

[45] Date of Patent: Apr. 8, 1986

[54] SPOOL FOR MATERIALS THAT CAN BE WOUND, SUCH AS ROPES, CABLES AND THE LIKE

[75] Inventors: Ernst Bauer; Joachim Burkert, both of Neustadt, Fed. Rep. of Germany

[73] Assignee: Industriewerk Nachf. Seifert & Co. KG, Neustadt, Fed. Rep. of Germany

[21] Appl. No.: 692,610

[22] Filed: Jan. 18, 1985

[30] Foreign Application Priority Data

Feb. 1, 1984 [DE] Fed. Rep. of Germany ..... 3403382

[51] Int. Cl.[4] ..... B65H 75/14

[52] U.S. Cl. ..... 242/118.6; 242/118.8

[58] Field of Search ..... 242/118.4–118.8, 242/115, 116, 71.8, 71.9; 206/401, 407, 414

[56] References Cited

U.S. PATENT DOCUMENTS

| | | | |
|---|---|---|---|
| Re. 20,106 | 9/1936 | Bureau | 242/77.4 |
| 2,058,151 | 10/1936 | Hayward | 242/77.4 |
| 2,494,521 | 1/1950 | Schaefer et al. | 242/77.3 |
| 2,561,288 | 7/1951 | Panzer | 242/77.3 |
| 2,767,936 | 10/1956 | Hubbard et al. | 242/118.7 |
| 4,066,225 | 1/1978 | Bauer | 242/118.8 |

*Primary Examiner*—Leonard D. Christian

*Attorney, Agent, or Firm*—Jordan and Hamburg

[57] ABSTRACT

A spool for materials which can be wound, such as ropes, cables and the like, includes a spool core and two spool flanges positioned on its axial ends, the flanges including a support structure having radial support members positioned between an inner ring and an outer ring, and an inside surface-like casing is supported on the support structure, the casing consisting of a plurality of individual segments, each segment being disposed between the radial support members, the segments being detachably fastened to the support structure.

17 Claims, 4 Drawing Figures

SPOOL FOR MATERIALS THAT CAN BE WOUND, SUCH AS ROPES, CABLES AND THE LIKE

BACKGROUND OF THE INVENTION

This invention relates to a spool for materials that can be wound, such as ropes, cables and the like, consisting of a spool core and two spool flanges positioned on the axial ends of the spool core the flanges having a support structure which includes radial support members disposed between an inner ring and an outer ring and an inside surface casing supported by this support structure.

Spools of this kind generally are constructed as fixed machine spools or as shipping spools which can be disassembled into two spool flanges and a spool core. Because it can be disassembled, after removing the wound cable or the like, it allows not only an economical return transport due to the reduced transport volume, but it also allows economical repairs when the core or the lining of the flanges is damaged. Cables, wire ropes and the like, which are wound on such spools, have a tendency to be rather sensitive to damaged flange linings or cores. In known spool constructions, the flange framework is a supporting element, whereas the flange lining has only a protective function for the coiled material. The lining also has the important function to protect the generally sensitive and, in any case, very expensive, coiled materials from damage, especially from the outside. Such flange linings consist of comparatively thin sheet metal, wood, plywood, plastic or the like. Because of the weight, the utilized construction materials are comparatively thin. These circumstances, as well as the rough operating conditions to which such spools are subjected during use and during transport, are the reasons why the flange linings are easily damaged. This damage-proneness applies also to the spool core. As a result repairs are required, if at all possible, and this considerably increases the cost of such spools. Thus spools of long working life are desirable.

According to the present invention, the aforementioned objective is achieved in that the casing of the flanges of the above mentioned kind of spools consist of a multitude of individual segments, whereby each segment occupies a space between two radial support members, and whereby the segments are detachably fastened to the support structure.

Although the configuration of the invention utilizes a plurality of parts for the casing, this configuration of the spool flange offers the considerable advantage that upon eventual damage of the flange lining, only one or more segments need to be replaced. This gives spools an extremely long working life, because it has been empirically shown that the support structure of such flanges is damaged only in the rarest cases due to outside influences, whereas the deterioration of the casing of the flange is the rule. The segments of the spool casing can have the same size so that their support mountings are not subjected to any limitations and so that the cost is contained within tolerable limits.

According to the present invention, the fastening of the individual segments is effected on two adjacent radial support members. In a given case, it is also possible to provide larger segments which are fastened on two radial support members separated from each other by one or more radial support members between them and which are correspondingly larger. The individual segments advantageously are secured by threaded fasteners or riveted to the radial support members of the support structure so that they can be removed for repairs.

Individual segments consist of an approximately flat plate with tapered edge surfaces which are at least partially intended for fastening to the support structure. Generally, fastening of the individual segments takes place on their radial edge surfaces. If it appears necessary, however, it is also possible to perform it on the inner and/or outer circumferential surfaces of the individual segments. The individual segments advantageously are made out of sheet metal, wood, plastic, glass-fiber reinforced plastic or the like.

Other features which are considered characteristic of the invention are set forth in the appended claims.

Although the invention is illustrated and described in relationship to specific embodiments, it is nevertheless not intended to be limited to the details shown, since various modifications and structural changes may be made therein without departing from the spirit of the invention and within the scope and range of equivalents of the claims.

The construction and operation of the invention, however, together with additional objects and advantages thereof will be best understood from the following description of specific embodiments when read in connection with the accompanying drawings.

DESCRIPTION OF THE PREFERRED EMBODIMENTS

Figure 1:
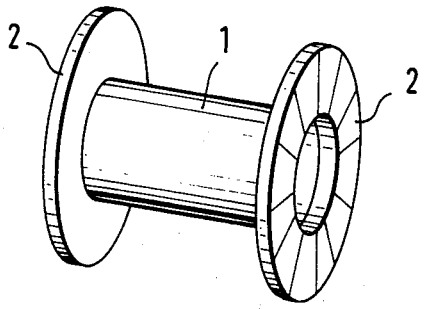
FIG. 1 is a schematic perspective view of a spool according to one embodiment of the invention.
Figure 2:
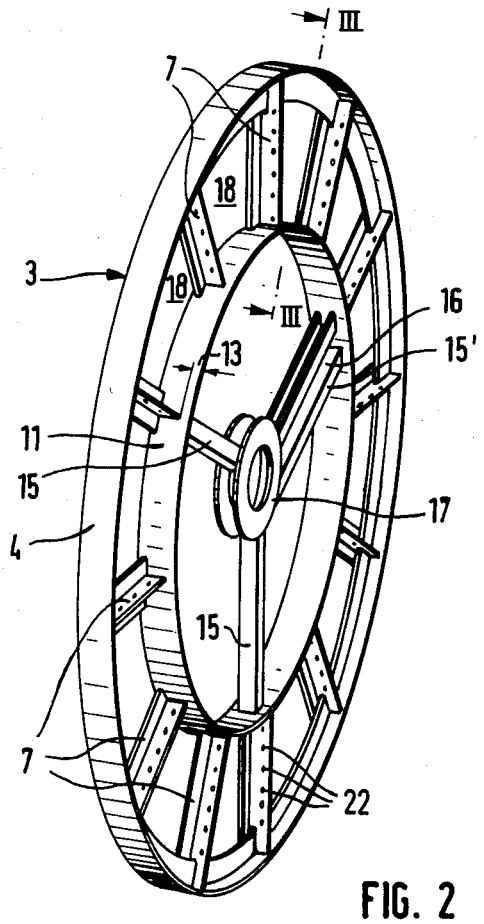
FIG. 2 is a perspective view, on a larger scale, of a spool flange.
Figure 3:
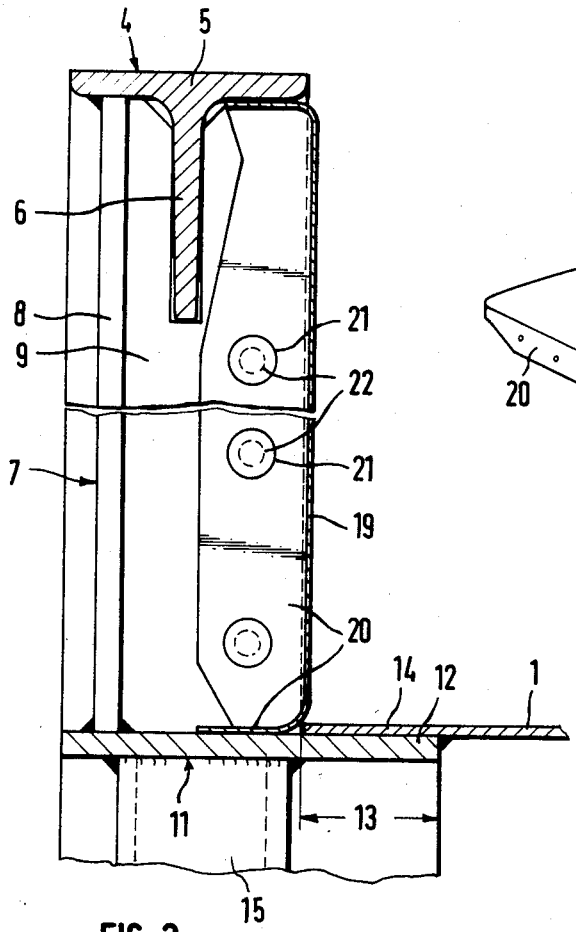
FIG. 3 is a sectional view taken approximately along the line III—III in FIG. 2.
Figure 4:
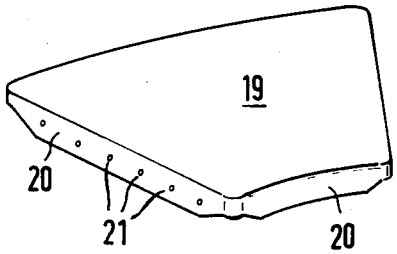
FIG. 4 is a partial perspective view of a casing segment.

Conventional spools of this kind, as well as the spool of the invention, consists of a spool core 1 and two flanges 2 which are positioned on its axial ends and between which the material, such as, for instance, cable, wire rope or the like, is wound. The core 1 is formed by a metal cylinder which is fixedly, or in the case of shipping spools, detachably connected to the flanges 2. Each flange 2 is provided with a support structure 3 which is shown in FIG. 2. It comprises an outer ring 4 which generally has a T-shaped profile, whereby its flange 5 forms the rolling surface and its bar 6 provides for the connection to radially extending support members 7. The members 7 also have a T-shaped profile with an outwardly extending T-flange 8 and an approximately radially extending T-bar 9. The inner ends of the members 7 are connected to each other by a ring 11 which serves as core support 12 as can be seen in FIG. 3. In the represented configuration, the support structure 3 of the spool flange 2 is of a welded construction. The inner ring 11 extends or projects in an axial direction to the inside over the frontal surface of the T-bar 9 of the radial support members 7. This projection 13 supports the axial end 14 of the core 1 and, according to the embodiment of FIG. 3, is welded to the core support 12. In a shipping spool, the preferred embodiment is a detachable connection between core 1 and flange 2.

Inside the inner ring 11 of the support structure 3, the represented embodiment is provided with three radial members 15, whereby the member 15' is configured as a double member and is provided with a space 16 for engagement of a cam when the spool is being operated. The members 15 are welded on their outer ends to the inner ring 11 and on their inner ends to a hub 17, which can hold or include a bearing axis during winding and unwinding of the wound material.

The spaces 18 between each two members 7 are provided with segment-like casing elements 19. The elements 19 are provided with edge surfaces 20 tapered towards the rear and which are provided with bores 21. These bores 21 correspond to bores 22 provided in the T-bars 9 of the radial members 7 which, upon insertion of the casing elements 19, align with the corresponding bores 22 so that between each two members 7, a casing element 19 can be detachably fastened by fastening means such as threaded members or rivets. In a given case, the casing elements 19 can also be configured larger and can extend, for instance, over two or more spaces 18 between the members 7. The casing elements 19 are made, for instance, of sheet metal or also fiber-reinforced plastic so that, on the one hand, they are sufficiently strong, and on the other hand, are as light as possible.

In case the lining of the spool is damaged during operation or a spool used as a shipping spool is damaged during transport, it only requires loosening of the screws or rivets of the particular casing element 19 needing replacement, removing the damaged casing element and replacing it with a new one which is again connected to the radial support members 7 by means of screws or rivets. In this way, it is not necessary to replace the entire spool flange in order to make the spool reusable. For each spool size there is required a support or mounting of a corresponding size of casing element 19.

What we claim is:

1. A spool for wound materials such as ropes, cables and the like comprising a spool core, flanges mounted on said core, said flanges having an inner ring and an outer ring, said outer ring having a generally T-shaped cross sectional configuration including a generally cylindrical portion and an inner flange portion, said inner flange portion extending radially inwardly from a generally central section of said cylindrical portion, radial support members extending between and fixedly mounted on said inner and outer rings, said radial support members being spaced from one another to form segment spaces therebetween, said radial support member having a generally T-shaped configuration including a first generally flat section disposed generally in a plane perpendicular to the axis of the spool and a second generally flat section disposed generally perpendicular to said first section, segment members disposed in said segment spaces, and fastening means for detachably fastening said segment members to said flange, whereby individual segments members can be replaced as desired.

2. A spool according to claim 1 further comprising means fixedly mounting said core on said inner ring.

3. A spool according to claim 1 wherein said fastening means comprises threaded fastening members.

4. A spool according to claim 1 wherein said fastening means comprises rivets.

5. A spool according to claim 1 wherein said segment members are made of metal.

6. A spool according to claim 1 wherein said segment members are made of plastic.

7. A spool according to claim 1 wherein said segment members are made of wood.

8. A spool according to claim 1 wherein said fastening means for detachably fastening said segment members are disposed on said second flat section of said radial support members.

9. A spool according to claim 1 further comprising a first connecting means connecting said radial support members to said cylindrical portion of said ourter ring, and inner connecting means connecting said radial support members to said inner ring.

10. A spool according to claim 1 wherein said inner ring is in the form of a cylinder having a first cylindrical section juxtaposed to the inner radial ends of said radial support members, and a second cylindrical section extending longitudinally beyond said radial support members, and core connecting means connecting said core to said second cylindrical section.

11. A spool according to claim 1 comprising a hub disposed within said inner ring, and radial connecting members connecting said hub and said inner ring.

12. A spool for wound materials, such as ropes, cables and the like comprising a spool core, flanges mounted on said core, said flanges having an inner ring and an outer ring, radial support members extending between and fixedly mounted on said inner and outer rings, said radial support members being spaced from one another to form segment spaces therebetween, segments members disposed in said segment spaces, said segment members each comprising a substantially flat plate section and edge surface sections extending generally perpendicularly from said flat plate section, said flat plate section being disposed generally in a plane perpendicular to the axis of said spool, said edge surface sections extending in a generally radial direction and being disposed to abut said radial support members, and fastening means for detachably fastening said abutting edge surface sections and said radial support members, whereby individual segment members can be replaced as desired.

13. A spool according to claim 12, wherein said inner and outer rings each include a cylindrical portion coaxial with the axis of said spool, said segment members having an outer edge surface and an inner edge surface, said outer edge surface abutting said cylindrical portion of said outer ring, said inner edge surface abutting said cylindrical portion of said inner ring.

14. A spool according to claim 13, wherein said outer edge surface has a partial cylindrical configuration coaxial with the axis of said spool.

15. A spool according to claim 14, wherein said inner edge surface has a partial cylindrical surface coaxial with the axis of said spool.

16. A spool according to claim 12, wherein said fastening means comprises fastening members generally symmetrical about a fastening axis, said fastening axis being disposed perpendicular to the axis of said spool.

17. A spool according to claim 12, wherein said outer cylindrical portion of said outer ring has a longitudinal inner end and a longitudinal outer end, said flat plate section of said segment members being generally aligned with said longitudinal inner end of said outer cylindrical portion such that the segment members form an inner radial wall for the spool, said fastening means being accessible through said longitudinal outer end.

* * * * *